US010295316B2

(12) United States Patent
Wukie

(10) Patent No.: US 10,295,316 B2
(45) Date of Patent: May 21, 2019

(54) VARIABLE CUTTING DIAMETER ARROWHEAD

(71) Applicant: Jacob Wukie, Fremont, OH (US)

(72) Inventor: Jacob Wukie, Fremont, OH (US)

( * ) Notice: Subject to any disclaimer, the term of this patent is extended or adjusted under 35 U.S.C. 154(b) by 0 days.

(21) Appl. No.: 15/656,735

(22) Filed: Jul. 21, 2017

(65) Prior Publication Data

US 2019/0025028 A1 Jan. 24, 2019

(51) Int. Cl.
*F42B 6/08* (2006.01)

(52) U.S. Cl.
CPC ..... *F42B 6/08* (2013.01)

(58) Field of Classification Search
CPC ..... F42B 6/08; F42B 12/34
USPC ..... 473/583
See application file for complete search history.

(56) References Cited

U.S. PATENT DOCUMENTS 3,036,395 A 5/1962 Nelson
5,066,021 A * 11/1991 DeLucia ..... F42B 6/08 473/583
5,458,341 A 10/1995 Forrest et al.
6,258,000 B1 7/2001 Liechty, II
6,830,523 B1 12/2004 Kuhn
6,918,848 B2 7/2005 Kuhn
7,713,152 B1 * 5/2010 Tentler ..... F42B 6/08 473/583
8,007,382 B1 8/2011 Sanford
8,043,177 B2 10/2011 Flanagan
8,128,521 B1 3/2012 Ulmer
8,133,138 B1 3/2012 Hannah
8,182,378 B1 5/2012 Futtere
8,210,971 B1 7/2012 Fulton
RE44,144 E 4/2013 Barrie et al.
8,449,416 B2 5/2013 Grace et al.
RE44,474 E 9/2013 Vandewater
8,894,519 B2 11/2014 Young
8,911,310 B2 12/2014 Lee
8,911,311 B1 12/2014 Mizek et al.
9,194,673 B1 11/2015 Lee
9,341,451 B1 5/2016 Campbell et al.
9,372,056 B2 * 6/2016 Sullivan ..... F42B 6/08
2009/0029811 A1 1/2009 Bolen, III
2011/0165977 A1 * 7/2011 Adams ..... F42B 6/08 473/583
2012/0040787 A1 * 2/2012 Ulmer ..... F42B 6/08 473/583

* cited by examiner

*Primary Examiner* — John E Simms, Jr.
*Assistant Examiner* — Rayshun K Peng
(74) *Attorney, Agent, or Firm* — BakerHostetler

(57) ABSTRACT

Arrowheads can include blades which remain deployed to a maximum cutting diameter on contact with soft media and deflect on contact with hard media in a target.

20 Claims, 6 Drawing Sheets

VARIABLE CUTTING DIAMETER ARROWHEAD

TECHNICAL FIELD

The present disclosure generally relates to arrowheads for archery, and more particularly relates to broadhead arrowheads with movable blades.

BACKGROUND

Broadhead arrowheads are typically those utilized for hunting midsize to large game animals. These arrowheads provide large cutting diameters to provide large wound channels leading to rapid exsanguination, providing an ethical kill.

In the archery industry, broadheads are made in two different configurations: fixed blade or expandable/"mechanical" broadhead. A fixed blade broadhead has blades immovably attached to a central ferrule. Fixed blades add surface area to an arrow's aerodynamic profile, reducing the accuracy of an arrow shot with a fixed blade broadhead attached.

With mechanical broadheads, the blades are closed, folded, or at least partially stowed in the ferrule before deployment. When the blades are not deployed, the surface area or profile of the arrowhead is reduced, increasing accuracy. On impact with a target, the blades deploy to provide a larger cutting diameter than could be provided by equally accurate arrowheads having fixed blades.

A variety of mechanisms are used to maintain a stowed or deployed position of the blades. A technique for retaining blades includes providing O-rings about the blades which are cut or roll to the base of the arrowhead or shaft of the arrow on impact, allowing the blades to deploy. Other techniques utilize various mechanisms based on the interaction of solid, inflexible components which may become seized if not maintained or if contaminants are encountered. Because mechanical broadheads include moving parts, problems can arise in their use. Failure to deploy, early deployment, or loss of energy needed for effective penetration all decrease the likelihood of recovering hit game.

When blades fail to deploy, the wound channel may be insufficient to inflict the damage required for fast expiry. When blades deploy early, or when penetrating energy is lost, the wound channel may not be deep enough to reach the target's vital organs, or the arrow may lose its trajectory or deflect. Effective penetration is especially critical to ethical harvest when the arrow strikes a bone such as a rib or scapula. Further, after an ideal hit with sufficient penetration, the arrow will exit through the animal, increasing the likelihood of an easily-tracked blood trail and speedy recovery of the harvested animal.

However, it is nearly inevitable that a broadhead will encounter bone or other harder tissue (e.g, cartilage) in addition to passing through skin, fat, muscle, and organs. To facilitate deep penetration and the production of exit wounds, it would be beneficial for a broadhead to maximize cutting diameter through soft tissue while flexing around hard tissue to avoid loss of penetration or significant deflection from the targeted vital portions of the body.

SUMMARY

In an embodiment, an arrowhead includes a ferrule and a blade having a cutting portion, a blade pivot aperture, and a deployment extension. The deployment extension includes a locking portion and an impact portion. The arrowhead also includes a pivot through the blade pivot aperture rotatably coupling the blade to the ferrule and a blade spring longitudinally aligned with the ferrule and disposed adjacent to the deployment extension. The arrowhead also includes a trigger mechanism configured to cause outward rotation of the blade from a stowed position to a deployed position upon actuation of the trigger mechanism.

In an embodiment, an arrowhead blade includes a cutting portion and a blade pivot aperture about which the arrowhead blade is configured to rotate. The arrowhead blade also includes a deployment extension having a locking portion and an impact portion, wherein the locking portion is subject to a first compressing longitudinal force and biased to resist outward rotation of the arrowhead blade up to an actuation resistance, wherein the impact portion is geometrically distinct from the locking portion, and wherein the impact portion is subject to a second compressing longitudinal force and biased to resist inward rotation of the arrowhead blade up to a deflection resistance.

In an embodiment, a method includes rotating a blade in an arrowhead. The blade rotates outward when an effective rearward force on a trigger mechanism exceeds an actuation force. The actuation force is based on a locking portion geometry of the blade and a first compressing longitudinal force on the locking portion geometry. The blade rotates inward when an effective rearward force on the blade exceeds a deflection force. The deflection force is based on an impact portion of the blade and a second compressing longitudinal force on geometry of the impact portion.

Additional and alternative aspects will be apparent on review of other portions of this disclosure.

BRIEF DESCRIPTION OF THE DRAWINGS

So that those having ordinary skill in the art, to which the present disclosure pertains, will more readily understand how to employ the novel system and methods of the present disclosure, certain illustrated embodiments thereof will be described in detail herein-below with reference to the drawings, wherein.

DETAILED DESCRIPTION

Figure 1A:
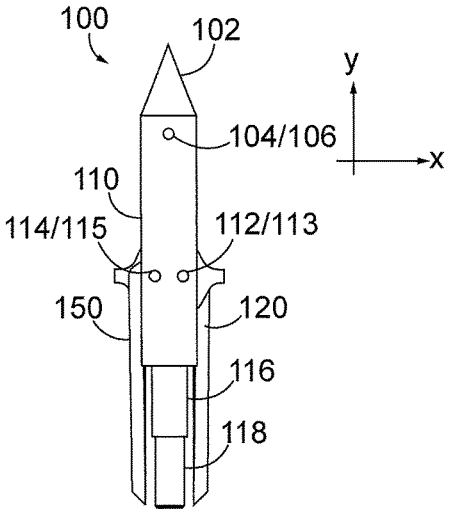
FIGS. 1A, 1B, 1C, 1D, and 1E illustrate an example arrowhead in accordance with the disclosures herein.
Figure 1B:
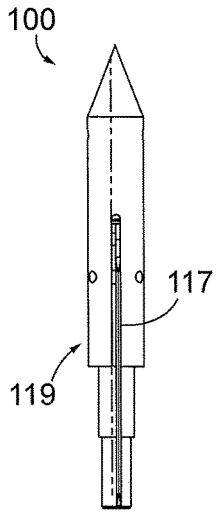
Figure 1C:
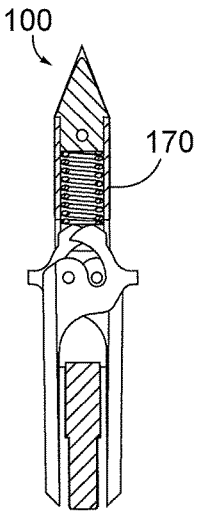
Figure 1D:
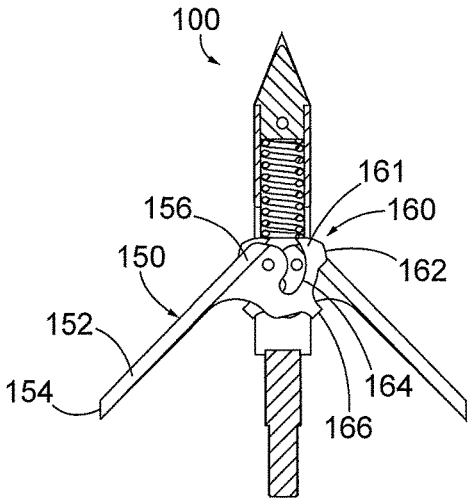
Figure 1E:
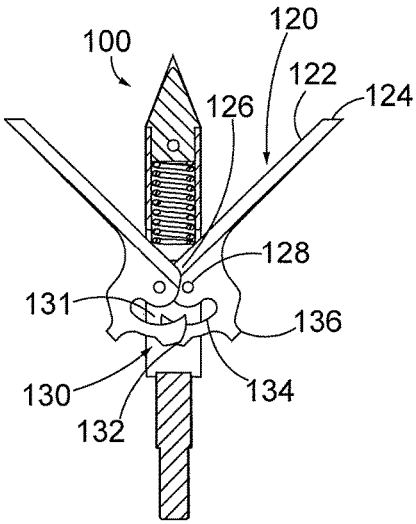

The disclosure generally pertains to broadhead arrowheads, blades for broadhead arrowheads, and methods for utilizing broadhead arrowheads. Arrowheads and technique disclosed provide an aerodynamic profile during flight by traveling with blades in a stowed configuration, and providing a larger cutting diameter with a wider profile after impact with a target. Disclosed arrowheads and techniques further provide the capability for blades to rotate, flex, deflect, or otherwise move after impact when hard or dense material is encountered, maintaining energy for penetration and the path of flight. By providing blades including uniquely shaped surfaces which interact with a spring, flexibility can be provided in spring specifications (and smaller springs may be employed) to fix the blades during passage through soft tissue and allow their deflection or rotation on contact with harder material.

Using a trigger mechanism, the blades may deploy on impact, after the arrowhead is partially within the target, or after the arrowhead is completely in the target. In embodiments, the blades do not open fully before the arrowhead has completely entered the animal, thereby reducing the initial energy loss as the wound channel is created but still providing a larger entry wound (which, with the exit wound if any, corresponds to external blood loss and a trackable blood trail) than would be provided by stowed blades. In alternative embodiments, the blades may not open or only open minimally prior to complete entry of the arrowhead, thereby increasing penetration. In alternative embodiments, the blades may fully open on contact with the animal, thereby maximizing the entry wound and wound channel.

Based on a compressive spring-loaded configuration, the blades can be maintained in a stowed position without the use of an 0-ring or failure-prone rigid mechanical components, thereby simplifying the arrowhead, its use, and its reliability.

Because the blades are permitted to move on contact with harder material, a sort of "shock absorbing" effect is provided. Blades arranged in this manner are less likely to fail under load as loads are reduced or mitigated by the blades' deflection. Blades can therefore be made of harder materials, providing edges that can be made and stay sharper than those produced of less brittle materials. The efficiencies provided by geometries of this broadhead also allow for lighter components, such as smaller springs, than would be possible if alternative designs not utilizing the blades disclosed herein.

A "blade" herein is one cutting member of an arrowhead including any portions or components continuously formed with the cutting portion. In embodiments, arrowheads can include one, two, three, four, or more blades. Blades herein can be described in terms of multiple parts. As used herein, a cutting portion of a blade is the portion of the blade defining the hole or wound channel in a target. At least a leading edge (e.g., edge facing the arrow's direction of travel when the blades are deployed) of a cutting portion is sharpened.

Aspects similarly illustrated may be described independently or together, using plural nouns or single or multiple articles of speech (e.g., "and," "or," "and/or"). For the avoidance of confusion, where described independently, portions of an element described or other elements may be described in series with the respective relationships understood from the drawings. In this manner, while some elements are illustrated similarly, it is understood that they may differ in varying embodiments even when discussed in series.

Deployment of the blades described herein is based on rotation of the blades about a pivot. In this regard, a blade can be defined by part of the blade proximal to the pivot—the "blade pivot aperture" in aspects—and a distal part, typically at an opposite end of the cutting portion. As used herein, "outward rotation" is rotation which moves the distal end away from the ferrule of the arrowhead, thereby increasing the cutting diameter of the arrowhead.

Aspects herein are described in terms of "resistance," used to describe the effective force resisting movement which rotates, displaces, or otherwise modifies the position or orientation of elements of the arrowhead. A force sufficient to overcome an actuation resistance or a deflection resistance is a force which overcomes the combined impediments to movement of the blade, including but not limited to the energy required to rotate or displace the blade and the biased portions which resist movement through contact with one or more compressed springs.

While aspects herein describe forces imposed by a spring as "increased" or "reduced" associated with different blade positions, alternative embodiments may reverse this arrangement without departing from the scope or spirit of the innovation, as those of ordinary skill in the art will appreciate modifications of component geometries to provide for such. Further, while forces may be described as "increased" and "reduced" or "first" and "second," it is understood that the force described may be provided from a single common element capable of imparting different magnitudes of force depending on orientation of related components. For example, a spring in compression may provide a compressing longitudinal force on components. The spring may provide a first force, which may be reduced relative to other configurations, when the components are in a first configuration, based on the amount of compression imparted on the spring. The same spring may provide a second force, which may be increased relative to other configurations, when the components are in a second configuration. These can also be described as first and second forces and may take any relative value with respect to one another. Further, there may be other force magnitudes, gradients, ranges, et cetera, based on the instantaneous positions of components.

As used herein, a "front" or "forward" element is disposed toward the tip of an arrowhead, or the direction of an arrow to which the arrowhead is attached in flight. Aspects which are to the "rear" or "behind" relative to others will be located away from the direction of flight of an arrow to which the arrowhead is attached and toward the shaft of the arrow to which the arrowhead is attached.

Turning to FIGS. 1A, 1B, 1C, 1D, and 1E, illustrated is an example embodiment of a variable cutting diameter arrowhead 100 disclosed herein. Arrowhead 100 includes a point 102, a ferrule 110, blades 120 and 150, and components for attaching arrowhead 100 to the shaft of an arrow including insert adapter 116 and thread adapter 118, which can be configured to operatively couple with an arrow insert. One or more components of arrowhead 100 can be formed of various metals, polymers, carbon fiber materials, and others, in varying combinations.

Ferrule 110 may be cylindrical. In alternative embodiments, ferrule 110 can include other cross-sectional shapes, such as polygons. Ferrule 110 in the illustrated embodiment includes at least one point pin hole 104. Point pin 106 passes through point pin hole 104 and point 102 to fixedly retain point 102 in arrowhead 100. Ferrule 110 also includes blade pin holes 112 and 114, through which blade pins 113 and 115 pass to movably couple blades 120 and 150. Blade pins 113 and 115 can be fixed to the blades and rotate within blade pin holes 112 and 114, fixed to ferrule 110 and allow blades 120 and 150 to rotate thereabout, or independent of both ferrule 110 and blades 120 and 150. Blade spring 170 is disposed within ferrule 110. In embodiments, blade spring 170 is a compression spring. Blade spring 170 may be annular, or otherwise meet with the cross-sectional shape of ferrule 110. In embodiments, blade spring 170 is concentric with ferrule 110. Blade spring 170 may be longitudinally aligned with ferrule 110. In embodiments, blade spring 170 is not concentric with ferrule 110. In embodiments, two or more blade springs can be utilized in series or parallel. In an alternative embodiment, blade spring 170 may be disposed outside and around ferrule 110 (e.g., where deployment extensions 130 and/or 160 extend through blade recesses 117 and/or 119). In embodiments, a washer, stopper, block, or buffer may be disposed between spring 170 and blades 120 and 150. A buffer may be disposed partially (e.g., flaring to a larger dimension adjacent to blades 120 and 150) or wholly within spring 170. A washer may be disposed between spring 170 and blades 120 and 150.

While point pin 106, blade pins 113 and 115, and other elements herein are described as pins or other specific hardware, alternatives can be utilized without departing from the scope or spirit of the innovation. For example, blade pins 113 and 115 can alternatively be any hardware facilitating pivot function. Further, in other embodiments, other means for providing ferrule 110 and point 102 can be utilized, such as adhesives or monolithic construction whereby ferrule 110 and point 102 are formed of a single piece of material. In alternative embodiments, other configurations may be provided allowing movement of point 102 in relation to ferrule 110. Blade 120 includes cutting portion 122 and blade 150 includes cutting portion 152, which can be comprised of one or more materials and sharpened on at least one side (e.g., the side facing the direction of arrow travel when the blades are deployed) to enhance cutting. Cutting portion 122 includes distal end 124 and proximal end 126, and cutting portion 152 includes distal end 154 and proximal end 156. Blade 120 further includes blade pivot aperture 128 and blade 150 further includes blade pivot aperture 158, about which blade 120 and/or blade 150 respectively rotate. Additional material comprising further portions of a body of blades 120 and 150 may intervene between labeled elements expressly described herein.

Blade 120 also includes deployment extension 130 and blade 150 includes deployment extension 160. In the illustrated embodiment deployment extension 130 includes locking portion 132 and impact portion 131, and deployment extension 160 includes locking portion 162 and impact portion 161, such having different geometries which interact with spring 170 and associated elements. Locking portions 132 and 162, and impact portions 131 and 161, can have various shapes including curved or straight portions which can be flat, jogged, offset, et cetera. While deployment extensions 130 and 160 are shown in the drawings to be of substantially similar width to other portions of blades 120 and 150 respectively, in embodiments deployment extension 130 and/or deployment extension 160 can widen, taper, or otherwise include greater or varying thickness to aid with interaction between blades 120 and 150 and spring 170. In an embodiment, deployment extension 130 and/or deployment extension 160 may include a T-shaped cross section (e.g., flat, wider portion on deployment extension to support a larger portion of blade spring 170) to provide greater surface area interacting with spring 170. In such embodiments, ferrule 110 and/or one or both of blade recesses 117 and/or 119 may be modified to accommodate passage of the geometry of deployment extensions 130 and/or 160.

Blade 120 can include channel portion 134 and blade 150 can include channel portion 164. Channel portion 134 provides clearance for rotation of blade 120 about pin 113 and channel portion 164 provides clearance for rotation of blade 150 about pin 115. Channel portion 134 can include a curved shape matched to the rotation of blade 120 and channel portion 164 can include a curved shape matched to the rotation of blade 150, but any other shape preventing interference with pins 113 and 115 can also be utilized. Channel portions 134 and/or 164 can also include varying width, in comparison respectively with blades 120 and 150.

Various trigger mechanisms can cause rotation of the blade 150 between deployed and stowed states. Deployment of blade 120 and/or blade 150 can occur individually or in combination.

In embodiments, blade 120 and blade 150 can be symmetrical or asymmetrical. Further, in embodiments, blade 120 and blade 150 can be supplemented by a third, fourth, or additional blades. Multi-blade embodiments can, but need not be required to, distribute blades evenly about ferrule 110 (e.g., 180 degree separation in two-blade embodiments; 120 degree separation in three-blade embodiments; 90-degree separation in four blade embodiments; et cetera).

In embodiments, blade 120 includes trigger extension 136 and blade 150 includes trigger extension 166. Trigger extension 136 can be one mechanism for triggering deployment of blade 120 and trigger extension 166 can be one mechanism for triggering deployment of blade 150, thereby increasing the cutting diameter of arrowhead 100. If a resistance greater than an actuation resistance is applied to trigger extension 136 or trigger extension 166, the trigger mechanism of arrowhead 100 is actuated and the blades deploy. In embodiments, trigger extension 136 protrudes from blade 120 at an angle and trigger extension 166 protrudes from blade 150 at an angle. The angle may be defined as the angle the longitudinal line parallel to the body of, or through the center of, ferrule 110. The angle may alternatively be defined as the angle defined by one or more edges of trigger extension 136 and/or trigger extension 166 respectively where trigger extension 136 diverges from the prevailing contour of blade 120 and trigger extension 166 diverges from the prevailing contour of blade 150. Alternatively, the angle may be defined according to a line drawn from the center (or another point of) one end of trigger extension 136 and/or trigger extension 166 (proximal to ferrule 110 when blade 120 and/or blade 150 is stowed) to an opposite end (distal to ferrule 110 when blade 120 and/or blade 150 is stowed). Such angles may be acute, obtuse, or right. In embodiments trigger extension 136 is substantially perpendicular to cutting portion 122 and/or cutting portion 152. Trigger extension 136 and/or trigger extension 166 may be defined according to a variety of shapes, including rectangles, triangles, or others, and may include barbs or other geometry arranged to catch target media to respectively deploy blade 120 and/or blade 150.

In embodiments ferrule 110 also includes blade recesses 117 and 119. Blade recess 117 and/or blade recess 119 can be voids, openings, channels, or other gaps within the construction of ferrule 110 configured to receive at least one of blades 120 and 150. At least a portion of blade 120 can nest at least partially in blade recess 117 and at least a portion of blade 150 can nest at least partially in blade recess 119. This reduces the profile of blades 120 and 150 when in a stowed position (e.g., length of blades 120 and/or 150 substantially aligned with ferrule 110 and not deployed). In embodiments, cutting portion 122 of blade 120 substantially or wholly nests in blade recess 117 and/or cutting portion 152 of blade 150 substantially or wholly nests in blade recess 119. When deployed, blade 120 can leave blade recess 117 and/or blade 150 can leave blade recess 119 by rotating to expand the cutting diameter of arrowhead 100.

In embodiments using trigger extension 136 and/or trigger extension 166, trigger extension 136 can also partially, substantially, or wholly nest in blade recess 117 and/or trigger extension 166 can also partially, substantially, or wholly nest in blade recess 119 when cutting portion 122 and/or cutting portion 152 is deployed. Trigger extension 136 and/or trigger extension 166 can assist with respective redeploying blade 120 and/or blade 150 when deflected inward after deployment when blade 120 and/or blade 150 come into contact with a sufficiently hard material, as rotation of blade 120 and/or blade 150 toward blade recess 117 and/or blade recess 119 will cause trigger extension 136 and/or trigger extension 166 to become more exposed. The resulting drag on trigger extension 136 and/or trigger extension 166 will cause redeployment of blade 120 and/or blade 150.

In embodiments, one or both of blades 120 and 150 can rotate beyond a deployed position to an orientation at which blades 120 and 150 stop against ferrule 110. This can facilitate, for example, easier removal of arrowhead 100 from a target by allowing blades 120 and 150 to align with and streamline to a reverse direction of travel during removal.

In embodiments, one or both of blade recess 117 can include a guard or be formed of a material to limit wear on cutting portion 122, and blade recess 119 can include a guard or be formed of a material to limit wear on cutting portion 152. When rotated beyond a deployment position, cutting portion 122 and/or cutting portion 152 may come into contact with ferrule 110 or spring 170, potentially denting or dulling cutting portion 122 and/or cutting portion 152 at one or more points. A guard, softer material, or other elements can be used to ensure cutting portion 122 and cutting portion 152 retain their edge along the entire length regardless of deployment. Such elements may be located in blade recess 117 or 119, on spring 170, or on a washer, stopper, block, or buffer disposed between spring 170 and blades 120 and 150. In a further embodiment, a blade stop can be included to prevent contact between cutting portions 122 and 152 and other elements when rotated beyond the deployment position(s). The blade stop may be located on or near cutting portions 122 and 152, contacting ferrule 110 or other elements to limit rotation of blades 120 and 150. In an alternative or complementary embodiment, a blade stop may be located within ferrule 110 between or adjacent to (e.g., forward or rearward of) blades 120 and 150, and block or catch blades 120 and 150 to limit their rotation. In an embodiment, blades 120 or 150 can be further modified to interact with a catch (e.g., additional extension or tang in channel; additional extension or stop respectively disposed between deployment extensions 130/160 and trigger extensions 136/166).

In use, arrowhead 100 is fired and impacts a target composed of one or more types of media (e.g., tissue structures). After point 102 creates an initial hole, ferrule 110 follows until trigger extensions 136 and 166 impact the target. Resistance on trigger extensions 136 and 166 encountering the media exceeds the actuation resistance because of the energy of the arrow and size of the existing hole. With the trigger mechanism actuated, blades 120 and 150 rotate respectively outward from blade recesses 117 and 119, deploying as locking portions 132 and 162 cease to interact with spring 170 and impact portions 131 and 161 now interact with spring 170. Arrowhead 100 continues through the target in this manner unless one or more of blades 120 and 150 impact a harder media sufficient to overcome the deflection resistance, such as bone. At this point, the load on blade 120 or blade 150 will exceed the deflection resistance, further compressing spring 170 as deployment extension 130 or deployment extension 160 rotate, and allow blade 120 or blade 150 to deflect toward ferrule 110, reducing the cutting diameter of arrowhead 100 and limiting drag on arrowhead 100 by avoiding the harder media. Once blade 120 or blade 150 passes the harder media and the load on blade 120 or blade 150 drops (thereby also reducing the compressive load on spring 170), blade 120 or blade 150 redeploys to its deployed position, re-introducing the increased cutting diameter. Arrowhead 100 will proceed in this manner until exiting the target or stopping in the target. If arrowhead 100 stops in the target, it can be pulled out in reverse. If it is pulled out in reverse, blades 120 and 150 may rotate beyond their deployed position to an extraction position as shown in, e.g., FIG. 1E. This aids in recovery of arrowhead 100 from the target as blades 120 and 150 align with the direction of travel for removal, decreasing the likelihood that they become "snagged" when pulled through the wound channel in reverse.

Figure 2A:
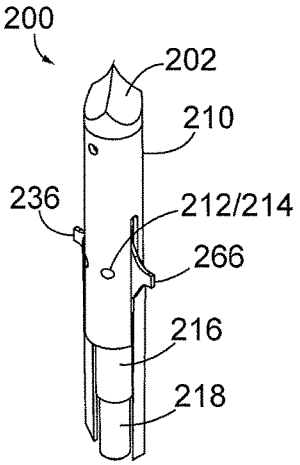
FIGS. 2A, 2B, and 2C illustrate an example arrowhead in accordance with the disclosures herein.
Figure 2B:
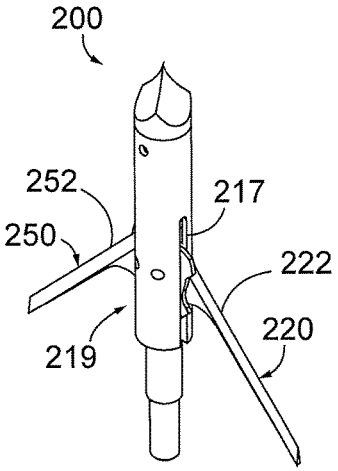
Figure 2C:
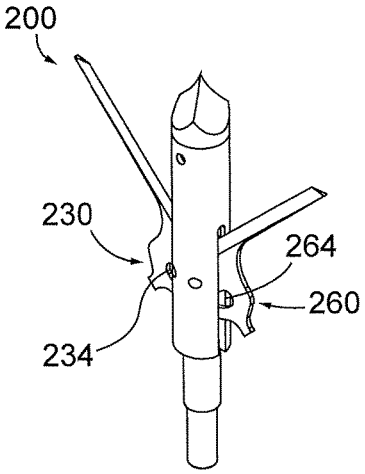

FIGS. 2A, 2B, and 2C illustrate an alternative embodiment of arrowhead 200 herein. Arrowhead 200. Arrowhead 200 is shown in a stowed configuration (FIG. 2A), deployed configuration (FIG. 2B), and a removal configuration (FIG. 2C).

Arrowhead 200 includes point 202, having a non-uniform geometry distinct from point 102. Points of arrowheads herein can take any shape or configuration without departing from the scope or spirit of the innovation. Arrowhead 200 also includes ferrule 210, blades 220 and 250, shaft adapter 216, and threaded adapter 218. Ferrule 210 includes blade recesses 217 and 219, in which blades 220 and 250 substantially nest when stowed, as well as at least one blade pivot aperture hole 212 corresponding to a pivot 214 which movably couples at least one of blade 220 and 250 with ferrule 210. A blade spring is disposed within ferrule 210 adjacent to point 202. Blades 220 and 250 can respectively include trigger extensions 236 and 266, cutting portions 222 and 252, deployment extensions 230 and 260 (which can in embodiments include locking and impact portions), channels 234 and 264, pivots (within ferrule 210), and other elements.

Figure 3:
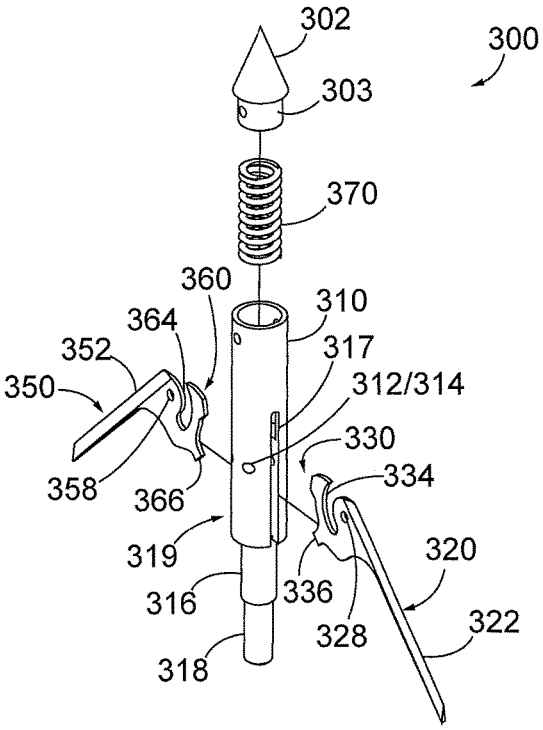
FIG. 3 illustrates an example arrowhead in accordance with the disclosures herein.

FIG. 3 illustrates an exploded view of an alternative embodiment of an arrowhead 300 herein. Arrowhead 300 includes point 302 having ferrule adapter 303, spring 370, ferrule 310, blade recesses 317 and 319, insert adapter 316, and thread adapter 318. One or more pin holes 312 can include one or more pins 314 to movably couple blades 320 and 350 to ferrule 310.

Blade 320 includes cutting portion 322, blade pivot aperture 328, deployment extension 330 (which may include locking and impact portions), channel portion 334, and trigger extension 336. Similarly, blade 350 includes cutting portion 352, blade pivot aperture 358, deployment extension 360 (which may include locking and impact portions), channel portion 364, and trigger extension 366.

Figure 4:
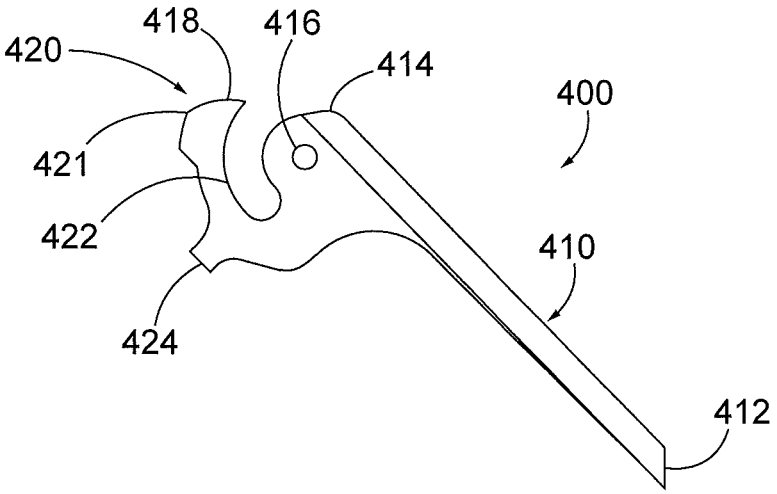
FIG. 4 illustrates an example arrowhead blade in accordance with the disclosures herein.

FIG. 4 illustrates an embodiment of an arrowhead blade 400. As can be appreciated using the disclosure herein, a variety of blade geometries can be utilized without departing from the scope or spirit of the innovation.

Arrowhead blade 400 includes cutting portion 410 with distal end 412 and proximal end 414. Arrowhead blade 400 also includes blade pivot aperture 416, deployment extension 420 having locking portion 421 and impact portion 418, channel 422, and trigger extension 424. Other portions of blade 400 include functional and ornamental aspects different from other blades herein as can be appreciated on comparison of the drawings.

Figure 5:
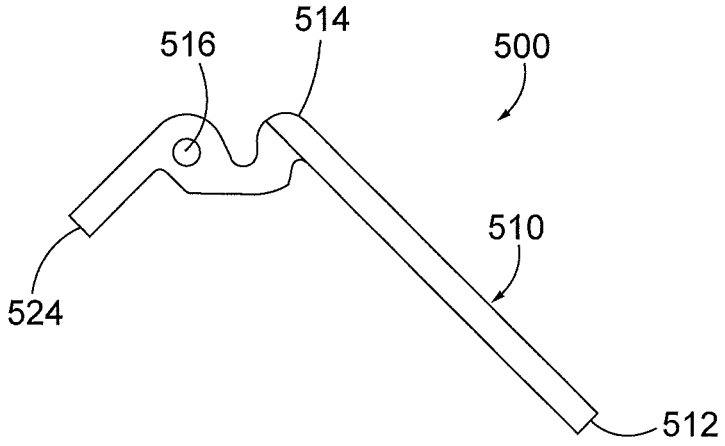
FIG. 5 illustrates an example arrowhead blade in accordance with the disclosures herein.

FIG. 5 illustrates a different embodiment of an arrowhead blade 500. Arrowhead blade 500 includes cutting portion 510 including distal end 512 and proximal end 514. Arrowhead blade 500 also includes pivot 516 and trigger extension 524. Other portions of blade 500 include functional and ornamental aspects different from other blades herein as can be appreciated on comparison of the drawings. In embodiments, arrowhead blade 500 can be utilized with an arrowhead which does not permit outward rotation of arrowhead blade 500 beyond a certain point (e.g., deployed position). Put another way, arrowhead blade 500 may not be permitted to pivot forward of its deployed position, ensuring the blades remain in a cutting configuration in the direction of travel.

As can be appreciated from FIGS. 4 and 5, the distal end of a blade can have various shapes. In FIG. 4, the distal end is angled with respect to the cutting surface, while in FIG. 5, the distal end is squared-off at a substantially right angle to the cutting surface. Other angles can be utilized without departing from the scope or spirit of the innovation.

Figure 6A:
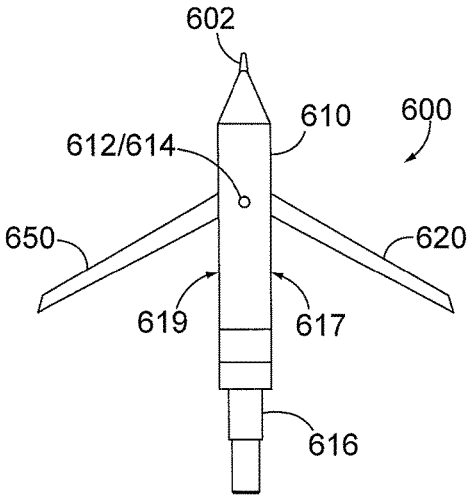
FIGS. 6A, 6B, and 6C illustrate another example arrowhead in accordance with the disclosures herein.
Figure 6B:
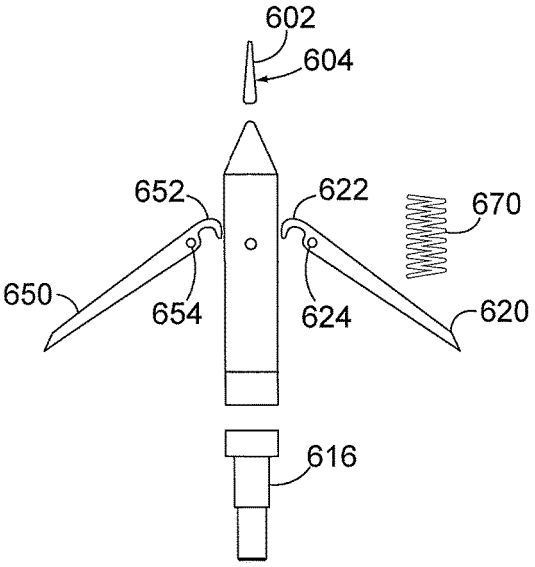
Figure 6C:
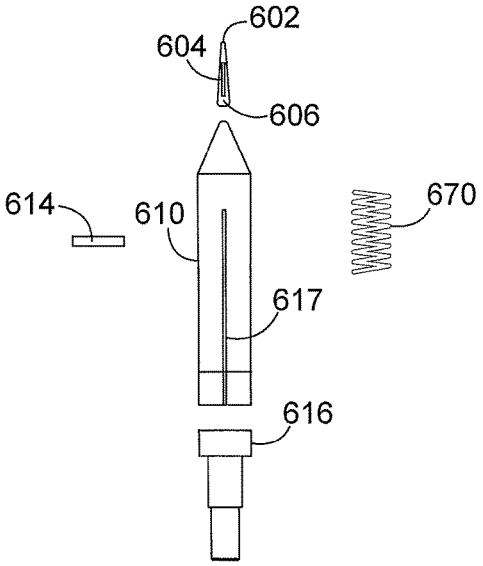

FIGS. 6A, 6B, and 6C illustrate assembled and exploded views of an embodiment of an arrowhead 600. Specifically, FIG. 6A shows a front view of arrowhead 600 assembled; FIG. 6B shows a front view of arrowhead 600 disassembled; and FIG. 6C shows a side view of arrowhead 600 disassembled. Not all elements are shown in each drawing, and/or further assembly or disassembly may be possible in embodiments.

Arrowhead 600 includes ferrule 610 operatively coupled with blade 620 and blade 650. Arrowhead 600 also includes blade spring 670 located adjacent to blade 620 and blade 650. In embodiments, blade spring 670 can be disposed forward of blades 620 and 650 in ferrule 610. Blades 620 and 650 are rotatably coupled to ferrule 610 using blade pivot pin 614 which passes through pivot pin hole 612. When stowed or not deployed, blades 620 and 650 can be at least partially housed in or shrouded by blade channels 617 and 619, respectively. Arrowhead 600 also includes adapter 616 which can be configured to operatively couple with an arrow.

Arrowhead 600 includes movable tip 602. Movable tip 602 includes tip aperture 604 and stop portion 606. Movable tip 602 interacts with blades 620 and 650 to prevent or permit their deployment.

Blade 620 includes deployment extension 622 and pivot aperture 624, and blade 650 includes deployment extension 652 and pivot aperture 654. Blades 620 and 650 are biased to deploy by spring 670. In embodiments, the force on blades 620 and 650 provided by spring 670 under compression seeks to cause blades 620 and 650 to extend outward of ferrule 610 by rotation. As with other embodiments, a solution utilizing re-compressible spring 670 allows the blades to move when impacting hard or dense media.

When movable tip 602 is extended, prior to impacting a target, stop portion 606 aligns with or blocks deployment extensions 622 and 652 from moving, thereby preventing rotation of blades 620 and 650 respectively. On impact, movable tip 602 is pushed rearward, thereby aligning tip aperture 604 with deployment extensions 622 and 652. Deployment extensions 622 and 652 pass through tip aperture 604 of movable tip 602, permitting rotation of blades 620 and 650 (respectively) about blade pivot pin 614, deploying blades 620 and 650.

In embodiments, deployment extensions 622 and/or 652 can also serve to prevent over-rotation of blades 620 and/or 650 by interacting with blade pivot pin 614 and/or movable tip 602. In an embodiment, deployment extensions 622 and/or 652 can "hook" blade pivot pin 614, thereby stopping them at a designed angle. Alternatively, blade pivot pin 614 or other elements may interfere with rearward movement of movable tip 602 beyond a certain location. Deployment extensions 622 and/or 652 may then encounter solid portions of movable tip 602 which cannot be displaced farther rearward, stopping travel of blades 620 and/or 650. In this manner, blades 620 and/or 650 may rotate back into ferrule 610, but cannot rotate outward of ferrule beyond a designed angle. This can keep blades 620 and/or 650 in particular cutting arrangements, and prevent damage to the cutting edge of blades 620 and/or 650 as might occur if they over-rotate into contact with ferrule 610 or other elements.

Figure 7A:
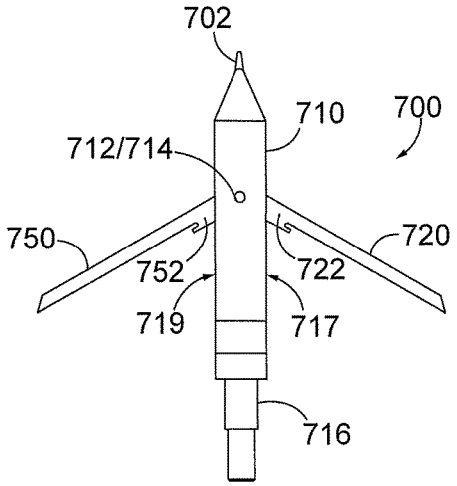
FIGS. 7A, 7B, and 7C illustrate another example arrowhead in accordance with the disclosures herein.
Figure 7B:
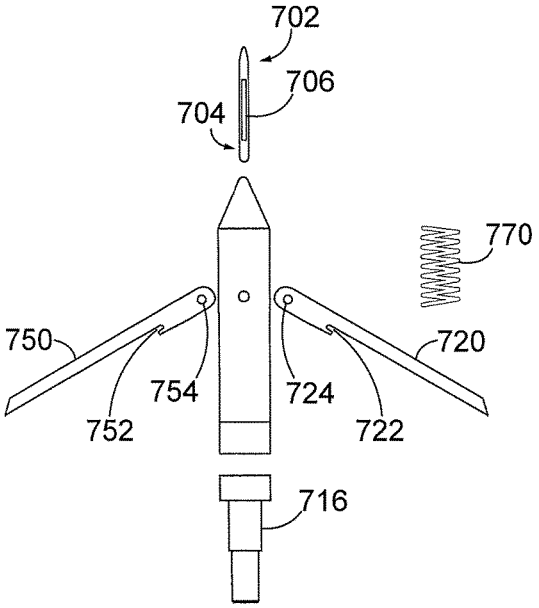
Figure 7C:
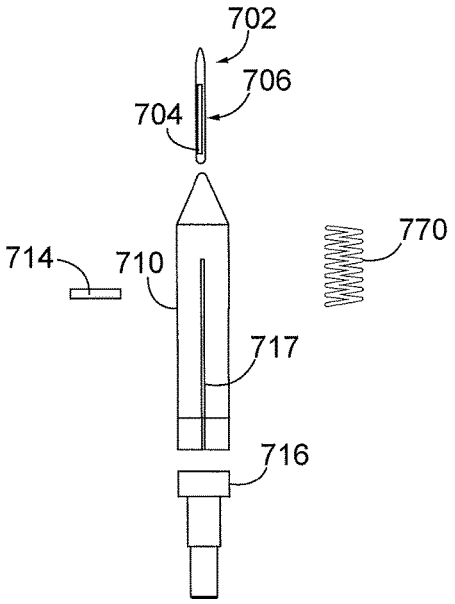

FIGS. 7A, 7B, and 7C illustrate assembled and exploded views of an embodiment of an arrowhead 700. Specifically, FIG. 7A shows a front view of arrowhead 700 assembled; FIG. 7B shows a front view of arrowhead 700 disassembled; and FIG. 7C shows a side view of arrowhead 700 disassembled. Not all elements are shown in each drawing, and/or further assembly or disassembly may be possible in embodiments.

Arrowhead 700 includes ferrule 710 operatively coupled with blade 720 and blade 750. Arrowhead 700 also includes blade spring 770 located adjacent to blade 720 and blade 750. In embodiments, blade spring 770 can be disposed forward of blades 720 and 750 within and toward the front of ferrule 710. Blades 720 and 750 are rotatably coupled to ferrule 710 using blade pivot pin 714 which passes through pivot pin hole 712. When stowed or not deployed, blades 720 and 750 can be at least partially housed in or shrouded by blade channels 717 and 719, respectively. Arrowhead 700 also includes adapter 716 which can be configured to operatively couple with an arrow.

Arrowhead 700 includes movable tip 702. Movable tip 702 includes deployment aperture 704 and pivot aperture 706, which are at least partially linear openings through movable tip 702 at angles to one another. In embodiments, deployment aperture 704 and pivot aperture 706 are "offset" by 90 or 180 degrees. In embodiments, more than two blades can be provided, providing different geometries and offsets for at least deployment aperture 704. Movable tip 702 interacts with blades 720 and 750 to prevent or permit their deployment.

Blade 720 includes deployment extension 722 and pivot aperture 724, and blade 750 includes deployment extension 752 and pivot aperture 754. Blades 720 and 750 are biased to deploy by spring 770. In embodiments, the force on blades 720 and 750 provided by spring 770 under compression seeks to cause blades 720 and 750 to extend outward of ferrule 710 by rotation. As with other embodiments, a solution utilizing re-compressible spring 770 allows the blades to move when impacting hard or dense media.

When movable tip 702 is extended, prior to impacting a target, deployment extensions 722 and 752 are "captured" within deployment aperture 704. Deployment extensions 722 and 752 are at least partially disposed within movable tip 702 through deployment aperture 704. Either by mating geometry or friction, blades 720 and 750 are retained in a stowed position so long as movable tip remains forward.

On impact, movable tip 702 is pushed rearward in ferrule 710. Pivot aperture 706 allows for portions of movable tip 702 to translate past pivot pin 714, which passes through pivot aperture 706 as movable tip 702 is pushed rearward. This moves deployment extensions 722 and 752 further into deployment aperture 704, removing the resistance to deployment. This permits rotation of blades 720 and 750 (respectively) about blade pivot pin 714, deploying blades 720 and 750.

While FIGS. 6A, 6B, 6C, 7A, 7B, and 7C show portions of ferrules 610 and 710 as being separate sections (e.g., taper toward tip in front of arrow or other sections), it is understood that these and other elements herein may be formed of separate pieces to be assembled or provided in single-piece or monolithic form without departing from the scope or spirit of the innovation.

Figure 8A:
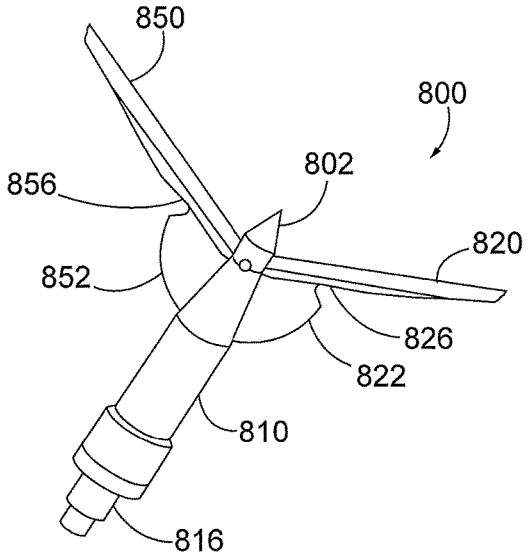
FIGS. 8A, 8B, and 8C illustrate another example arrowhead in accordance with the disclosures herein.
Figure 8B:
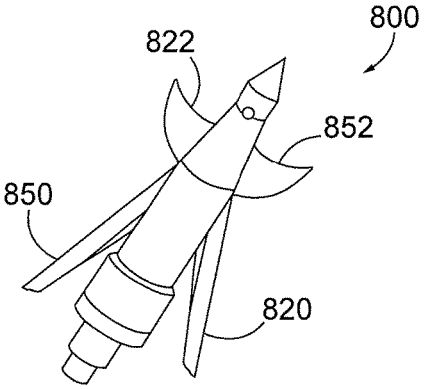
Figure 8C:
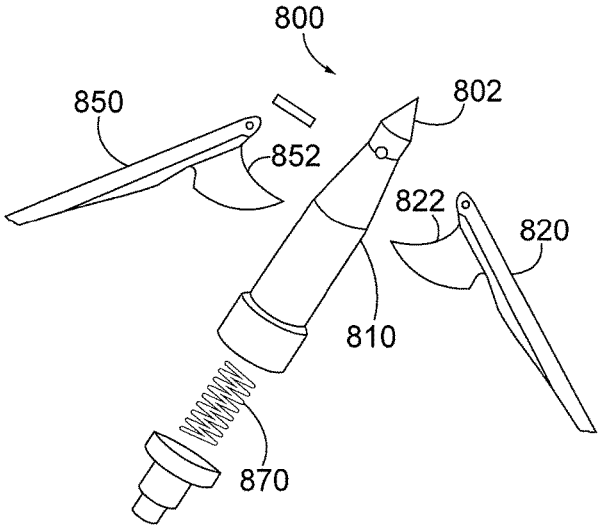

FIGS. 8A, 8B, and 8C illustrate another example embodiment of an arrowhead 800. Arrowhead 800 includes point 802, ferrule 810, and adapter 816. Arrowhead 800 can include a spring disposed in ferrule 810 rearward of point 802, blade 820, and blade 850.

Blades 820 and 850 can include deployment extensions 822 and 852 which pass through ferrule 810 to be exposed for deployment. Deployment extensions 822 and 852 can function similar to other deployment extensions herein, with the difference being the arrangement of locking portions 826 and 856 (respectively), which are oriented rearward to interact with the rear spring arrangement. While locking portions 826 and 856 are shown in a certain configuration, embodiments of these aspects may be exaggerated in the drawings for illustrative purposes (e.g., shape may be less distinct from prevailing contours than shown). None of FIGS. 8A, 8B, 8C, or any other drawing necessarily shows required dimensioning, scaling, or ratios of sizes between elements.

On impact, deployment extensions 822 and 852 create drag overcoming actuation resistance based on force imparted on locking portions 826 and 856 by the internal rear spring. Blades 820 and 850 then deploy, but the spring's interaction with the impact portion (e.g., rearward radius) of deployment extensions 822 and 852 facilitates movement of the blades based on impact with hard or dense media.

In embodiments, blade 820 and/or blade 850 can include a channel through at least a portion of deployment extension 822 and/or deployment extension 852 to eliminate interference between deployment extension 822 and/or deployment extension 852 and pivots or pins about which blade 820 and/or blade 850 rotates.

In further alternative embodiments, a deployment extension of a blade may include a single geometry (e.g., radius, curve, edge, angle) with which a spring interacts. In such embodiments the blades remain fully deployed except on impact with hard media such as bone. In this regard a "modified fixed blade" that allows for inward deflection of blades to achieve superior performance and facilitate integration of harder materials can be provided. Embodiments of such using a blade spring may be described as embodiments having only an impact portion and no locking portion.

In embodiments herein, either with a locking portion and an impact portion or an impact portion only, a stop can be included on a blade. The stop can resist motion beyond a deployed configuration to prevent blades from rotating outward past a deployment angle. In embodiments, the stop is a "hard stop" which prevents any further rotation. In embodiments the stop may be a "soft stop," which resists up to a certain force where after the stop is overcome through compressive force on the spring. Stops herein can include extensions or gaps which protrude outward of or inward to other portions of a blade.

In additional embodiments, an arrow can be provided including an arrowhead disclosed herein. The arrow can include a shaft, an insert, fletching, and a nock. The arrow and its components can be constructed of carbon fiber, aluminum or other metals, wood or other natural materials (e.g., feathers), polymers, and other materials. The arrow can include accessories such as a lighted nock.

In embodiments, the geometries of blade elements can be configured to provide particular compression distances of blade springs associated with amounts of deflection. This can be dependent on, e.g., the lateral distance between the blade pivot aperture and the point at which the spring contacts the blade (e.g., distance component horizontal to the longitude of the ferrule or x-axis in FIG. 1A). If this distance is defined as D, a particular embodiment may result in a spring compressing 0.5 to 1.0 times D for each 45 degrees of blade rotation. In a further embodiment, a spring may compress 0.75 to 0.8 times D for each 45 degrees of blade rotation. In a particular embodiment, a spring may compress between 0.78 to 0.79 times D, including 0.7855 times D, for each 45 degrees of blade rotation. In alternative embodiments a spring may compress less than 0.5 or greater than 1.0 times D for each 45 degrees of blade rotation. In embodiments, an actuation resistance can be any force greater than zero. In embodiments, because arrowhead blades are more massive than trigger extensions, they may remain closed in flight by their physics. However, to prevent their movement during transport, a blade spring and/or the geometry of locking portions of deployment extensions may be configured to provide actuation resistance greater than zero. In embodiments actuation resistance can be calculated to match resistances associated with typical tissue densities. While actual force values will vary based on blade design, in embodiments elements of an arrowhead the locking portions and spring can be designed around actuation resistances associated with media of density less than, e.g., 0.5 grams per cubic centimeter, 0.75 grams per cubic centimeter, 0.9 grams per cubic centimeter, 1.0 grams per cubic centimeter, et cetera. This prevents deployment until tissue such as skin, fat, organ, or muscle (or similarly-dense or denser other materials) are hit. Likewise, a blade spring and impact portion of a deployment extension may be provided to calibrate a deflection resistance to harder media. For example, a deflection resistance may be designed based on at least a blade spring and an impact portion such that a respective blade may deflect toward a coupled ferrule when densities greater than 1.0 grams per cubic centimeter, 1.1 grams per cubic centimeter, 1.5 grams per cubic centimeter, or 1.75 grams per cubic centimeter are encountered.

In alternative or complementary embodiments, blade springs and/or blade geometries can be configured to match other material properties, such as hardness or a material's resistance to failure or yielding as a function of both material properties and material geometry. In this manner, a small, dense bone can still be cut, but a larger bone of the same material may allow deflection; or a hard bone which is not particularly dense (e.g., bones in a game bird) can cause (or not cause) deflection of one or more contacting blades based on actual results as translated to the arrowhead and/or arrow, as opposed to contact with a particular medium.

As discussed elsewhere herein, drawings showing two-blade embodiments can be adapted to include three or more blades. Further, some embodiments may be modified to single-blade arrangements.

It is understood that such aspects are provided for example purposes only and may generalize consideration of calibration and/or construction. For example, it is unlikely the entire blade or arrowhead will be entirely in contact with a single media, instead simultaneously and sequentially encountering hair, hide, fat, muscle, bone, organ, and so forth. Thus, calibration to particular environments or targets can be based on combinations of density values, hardness values, and/or other material characteristics, or values derived therefrom. Calibration, selection of components, and construction can also be based on experimentation or other processes used by those of skill in the art.

While aspects herein are shown coupled in particular manners, such as pinning or screwing, it is understood that alternative techniques providing similar results are embraced by the scope and spirit of the innovation. For example, adhesives, monolithic construction, welding, fusing, clamping, crimping, and the use of alternative hardware or components, or the use of alternative coupling techniques, can be utilized for connecting elements of arrowheads herein.

While aspects of the present disclosure have been particularly shown and described with reference to the examples above, it will be understood by those skilled in the art that various combinations of the disclosed aspects or additional aspects may be contemplated by the modification of the disclosed machines, systems and methods without departing from the spirit and scope of what is disclosed. Such aspects should be understood to fall within the scope of the present disclosure as determined based upon the claims and any equivalents thereof.

What is claimed is:

1. A variable cutting diameter arrowhead, comprising:

a ferrule;

a blade having a cutting portion, a blade pivot aperture, and a deployment extension, wherein the deployment extension includes a locking geometry and an impact geometry;

a pivot through the blade pivot aperture rotatably coupling the blade to the ferrule;

a blade spring longitudinally aligned with the ferrule and disposed adjacent to the deployment extension, wherein the locking geometry and the impact geometry are configured to compress the blade spring to different lengths when rotated to interact with the blade spring; and a trigger mechanism configured to cause outward rotation of the blade from a stowed position to a deployed position upon actuation of the trigger mechanism, wherein the locking geometry is under compression from the blade spring when the blade is rotated in the stowed position, wherein the locking geometry biases the blade to resist the outward rotation up to an actuation resistance and allow outward rotation above the actuation resistance, wherein the impact geometry is geometrically distinct from the locking geometry, wherein the impact geometry is under compression from the blade spring when the blade is rotated in a deployed position, wherein after the blade is rotated into the deployed position the impact geometry biases the blade to resist inward rotation of the blade up to a deflection resistance and allow inward rotation above the deflection resistance, wherein the actuation resistance is based on a first compressing longitudinal force applied to the locking geometry when the blade spring is aligned with the locking geometry, and wherein the deflection resistance is based on a second compressing longitudinal force applied to the impact geometry when the blade spring is aligned with the impact geometry.

2. The variable cutting diameter arrowhead of claim 1, further comprising:

a point operatively coupled with the ferrule, wherein the point is adjacent to the blade spring.

3. The variable cutting diameter arrowhead of claim 2, wherein the point is fixedly coupled with the ferrule.

4. The variable cutting diameter arrowhead of claim 2, wherein the point is movably coupled to the ferrule, and wherein force on the point greater than the actuation resistance causes actuation of the trigger mechanism.

5. The variable cutting diameter arrowhead of claim 1, further comprising:

a trigger extension of the blade, wherein resistance against the trigger extension greater than the actuation resistance causes actuation of the trigger mechanism.

6. The variable cutting diameter arrowhead of claim 5, wherein the trigger extension protrudes at an angle to the cutting portion.

7. The variable cutting diameter arrowhead of claim 5, further comprising:

a blade recess of the ferrule, wherein the trigger extension is configured to substantially nest in the blade recess when the blade is in the deployed position.

8. The variable cutting diameter arrowhead of claim 1, further comprising:

a blade recess of the ferrule, wherein the cutting portion of the blade is configured to substantially nest in the blade recess when the blade is in the stowed position.

9. The variable cutting diameter arrowhead of claim 1, wherein one or more of the locking geometry or the impact geometry is curved.

10. The variable cutting diameter arrowhead of claim 1, wherein one or more of the locking geometry or the impact geometry is straight.

11. The variable cutting diameter arrowhead of claim 1, further comprising:

a channel portion of the blade.

12. The variable cutting diameter arrowhead of claim 11, further comprising:

an additional blade; and an additional blade pin rotatably coupling the additional blade to the ferrule, wherein the channel portion of the blade is configured to translate about the additional blade pin during rotation of the blade.

13. The variable cutting diameter arrowhead of claim 1, wherein the blade has a blade end distal to the blade pivot aperture, and wherein the blade end moves away from the ferrule during outward rotation.

14. An arrowhead blade, comprising:

a cutting portion;

a blade pivot aperture about which the arrowhead blade is configured to rotate; and a deployment extension having a locking geometry and an impact geometry, wherein the locking geometry is subject to a first compressing longitudinal force configured to be applied to the locking geometry based on contact of the locking geometry with a blade spring, wherein the blade spring is longitudinally aligned with a ferrule and disposed adjacent to the deployment extension when the blade is rotated in a stowed position, wherein the locking geometry biases the blade to resist outward rotation of the arrowhead blade up to an actuation resistance, wherein the actuation resistance is a function of the first compressing longitudinal force, wherein the impact geometry is geometrically distinct from the locking geometry, wherein the impact geometry is configured to be under compression from the blade spring when the blade is rotated in a deployed position, wherein the impact geometry is subject to a second compressing longitudinal force configured to be applied to the impact geometry based on contact of the impact geometry with a blade spring, wherein after the blade is in the deployed position the impact geometry biases the blade to resist inward rotation of the arrowhead blade up to a deflection resistance and allow inward rotation above the deflection resistance, and wherein the deflection resistance is a function of the second compressing longitudinal force.

15. The arrowhead blade of claim 14, wherein the actuation resistance overcomes the first compressing longitudinal force when the locking geometry is subject to the first compressing longitudinal force.

16. The arrowhead blade of claim 14, wherein the deflection resistance overcomes the second compressing longitudinal force when the impact geometry is subject to the second compressing longitudinal force.

17. The arrowhead blade of claim 16, further comprising:

a channel configured to translate about a pin during rotation of the arrowhead blade.

18. A method, comprising:

causing rotation of a blade in an arrowhead, wherein the blade has a cutting portion, a blade pivot aperture, and a deployment extension, wherein the deployment extension includes a locking geometry and an impact geometry, wherein the arrowhead has a pivot through the blade pivot aperture rotatably coupling the blade to a ferrule, wherein the arrowhead has a blade spring longitudinally aligned with the ferrule and disposed adjacent to the deployment extension, wherein the locking geometry and the impact geometry are configured to compress the blade spring to different lengths, wherein the arrowhead has a trigger mechanism configured to cause outward rotation of the blade from a stowed position to a deployed position upon actuation of the trigger mechanism, wherein the blade rotates outward when an effective rearward force on the trigger mechanism exceeds an actuation force, wherein the actuation force is based on a locking geometry of the blade and a first compressing longitudinal force applied to the locking geometry when the blade spring is aligned with the locking geometry, wherein the blade rotates inward after the blade is rotated into the deployed position when an effective rearward force on the blade exceeds a deflection force, wherein the deflection force is based on the impact geometry of the blade and a second compressing longitudinal force applied to the impact geometry when the blade spring is aligned with the impact geometry.

19. The arrowhead blade of claim 14, further comprising a trigger extension that protrudes at an angle to the cutting portion.

20. The variable cutting diameter arrowhead of claim 8, further comprising a cutting edge of the cutting portion, wherein the cutting edge is on an outward edge of the blade when the cutting portion is nested and wherein the cutting edge is rotated toward a direction of arrow flight when the blade is deployed from being nested.

* * * * *